US006857621B1

(12) United States Patent
Kamarad et al.

(10) Patent No.: US 6,857,621 B1
(45) Date of Patent: Feb. 22, 2005

(54) QUICK CONNECT FENCE POST

(76) Inventors: Rodney R. Kamarad, HCR 68 Box 50, Comstock, NE (US) 68828; Darrell R. Kamarad, 7100 E. Evans Ave., Apt. 217, Bldg. A, Denver, CO (US) 80224

( * ) Notice: Subject to any disclaimer, the term of this patent is extended or adjusted under 35 U.S.C. 154(b) by 0 days.

(21) Appl. No.: 10/726,761

(22) Filed: Dec. 4, 2003

Related U.S. Application Data

(63) Continuation-in-part of application No. 10/428,492, filed on May 3, 2003, now Pat. No. 6,695,293.

(51) Int. Cl.[7] ..... F16B 17/13
(52) U.S. Cl. ..... 256/48; 256/47; 256/10
(58) Field of Search ..... 256/32, 47, 48, 256/10, 19

(56) References Cited

U.S. PATENT DOCUMENTS 1,000,774 A * 8/1911 Buechele ..... 256/48
1,075,988 A * 10/1913 Melchert et al. ..... 256/47
2,836,397 A * 5/1958 Morrissey ..... 256/40
4,905,968 A * 3/1990 Eby et al. ..... 256/10

* cited by examiner

*Primary Examiner*—John Cottingham
(74) *Attorney, Agent, or Firm*—Edwin H. Crabtree; Ramon L. Pizarro; Donald W. Margolis

(57) ABSTRACT

A fence post with horizontal studs used for quick fence wire connection. The fence wire connection used for securing a portion of the fence wire next to the fence post. The fence post with a quick fence wire connection is designed to eliminate the use of a separate tying wire and twisting of the tying wire on the fence post using a pair of pliers. The fence post includes a plurality of equally spaced pairs of horizontal studs disposed along the length of one side of the post. An equally spaced wire gap is provided between each of studs. The wire gap is dimensioned for receiving a portion of fence wire therein. Each of the horizontal studs has a side profile of a rectangular geometric shape or similar geometric shape and with a vertical base integrally attached to the side of the post and a parallel vertical top. An upper side of each stud is parallel to a lower side of the stud. In each of the studs is a vertical locking pinhole with an upper opening in the upper side and a lower opening in the lower side. The locking pinhole is used for receiving an inverted "L" shaped locking pin. The locking pinholes in the adjacent horizontal studs are parallel and indexed with each other for receiving the "L" shaped locking pin therethrough and holding the wire in the wire gap.

19 Claims, 1 Drawing Sheet

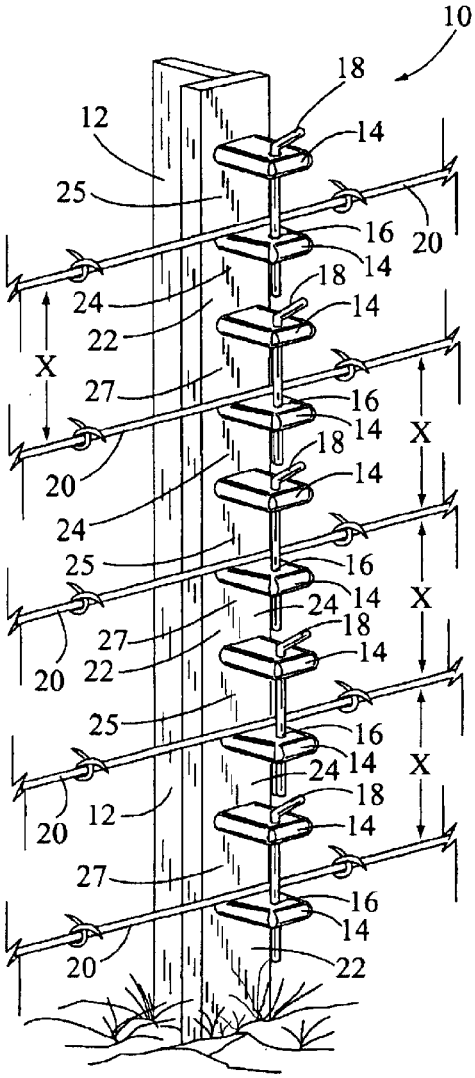
FIG. 1
FIG. 2
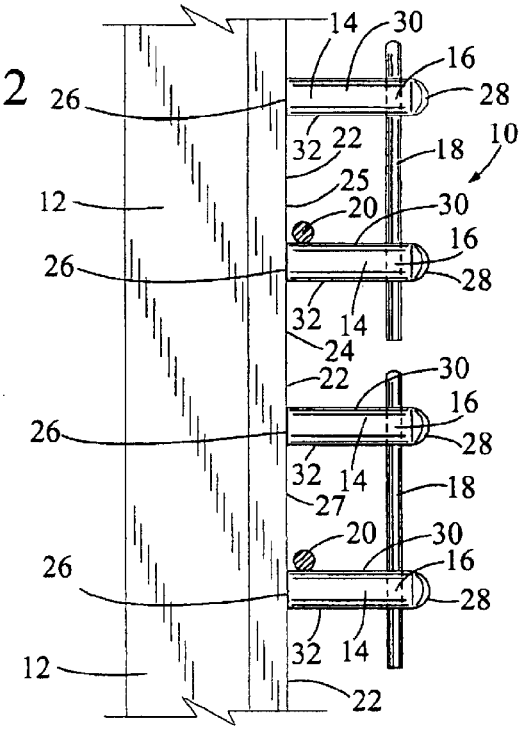
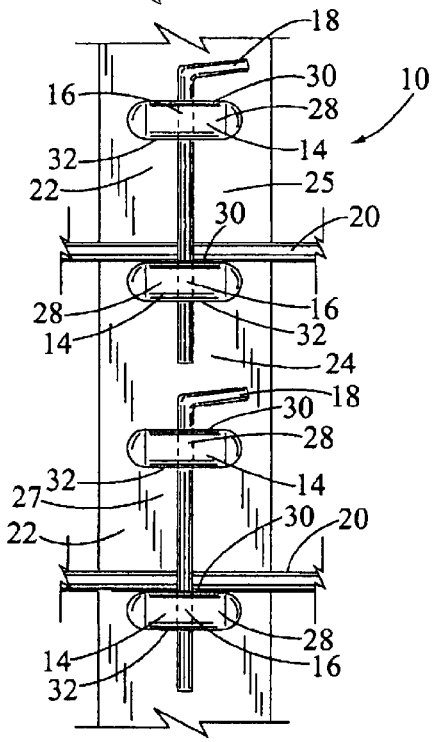
FIG. 3

QUICK CONNECT FENCE POST

This application is a continuation-in-part patent application based on an earlier filed application having a title of "METAL FENCE POST WITH QUICK FENCE WIRE CONNECTION" filed on May 3, 2003 and having Ser. No. 10/428,492 by the subject inventors which is now U.S. Pat. No. 6,695,293.

BACKGROUND OF THE INVENTION (a) Field of the Invention

This invention relates to fence posts used with barbed wire and other types of fence wire and more particularly, but not by way of limitation, to a fence post with a quick connection for securing a portion of the fence wire next to the fence post.

(b) Discussion of Prior Art

Heretofore, farmers and ranches have used different designs of fence posts with barbed wire for containing livestock. Also, hog wire, chicken wire, electric fence wire and other types of fence wire are used with fence posts. Typically two to five strands of spaced apart wire are attached to the posts. Some of the prior art fence posts include a plurality of studs extending outwardly and along a length of a side of the posts. The studs are used to help hold tying wire used to secure a portion of the fence wire to the side of the post.

Currently, the use of a separate tying wire is a method of choice in securing fence wire to the side of a fence post. The tying wire is wrapped around a portion of the fence post and a portion of the fence wire and snugly tied using a pair of pliers. The problem with using tying wire is it takes time and is tedious to manipulate. Also, the tying wire can come loose and the tying wire and the fence wire can slide vertically along the length of the fence post. When the fence wire is allowed to slide, the strands of wire attached to the fence post are no longer parallel to each other and uneven distances between the wire strands occur. The uneven distances between the strands expose a space, which attracts livestock to crawl through. Also because barbed wire is difficult to stretch, barbs are snagged against the fence post, when the tying wire is twisted around the wire and against the side of the fence post.

In U.S. Pat. No. 3,266,778 to Wogerbauer, an espalier metal stake is disclosed for threading wire through lopes in flanges of the stake. The stake and the wire is used for holding fruit and vegetable vine plants. In U.S. Pat. Nos. 2,221,477 to Gustafson and 2,836,397 to Morrissey, two different types of chain link fence attachments are described. The attachments are used for holding the chain link fence next to a side of a fence post.

The above mentioned prior art patents and the method of securing a portion of a strand of fence wire to a fence post using a separate tying wire do not disclose or provide the unique features, structure, function and advantages of the subject fence post having a quick fence wire connection as described herein.

SUMMARY OF THE INVENTION

In view of the foregoing, it is a primary objective of the subject invention to provide a fence post with horizontal studs for quick fence wire connection that eliminates the use of a separate tying wire and eliminates twisting of the tying wire on the fence post using a pair of pliers, which is time consuming and tedious. Also, the studs can have various geometric shapes, such as rectangular, square, round, triangular and the like for quick wire connection. Further, the fence post can be made of metal, fiberglass and other types of fence post material.

Another object of the invention is a portion of barbed wire or other types of wire fence can be quickly held in a wire gap between a pair of horizontal studs disposed along the length of a side of the fence posts.

Yet another object of the invention is through the use of the pair of horizontal studs with a stud pin, a strand of wire will no longer slip vertically along a length of the fence post. The slippage of the wire on the post causes an uneven distance between strands of wire allowing a space for livestock to crawl through.

Still another object of the invention is the fence post with the horizontal studs and stud pin can be used with a variety of different types of fence wire. Also barbed wire with barbs thereon does not interfere with the attachment of the wire to the side of the fence post.

The subject invention includes a fence post with a plurality of pairs of horizontal studs spaced along one side of the post. A wire gap is provided between each pair of the studs. The studs are equally spaced from each other and along the length of the fence post. The wire gap is dimensioned for receiving a portion of fence wire therein. Each of the studs has a side profile of a rectangular geometric shape with a vertical base integrally attached to the side of the post and a parallel vertical top. Opposite ends of the vertical top can be rounded or beveled and the edges rounded for ease in inserting wire between the studs. Each of the studs has a vertical locking pinhole with an upper opening in an upper side and a lower opening in a lower side. The locking pinhole is used for receiving an inverted "L" shaped locking pin. The locking pinholes in the adjacent studs are parallel and indexed with each other for receiving the "L" shaped locking pin therethrough and holding the wire in the wire gap.

These and other objects of the present invention will become apparent to those familiar with the fence posts and fence wire connections when reviewing the following detailed description, showing novel construction and combination of elements and function as described, and more particularly defined by the claims, it being understood that changes in the embodiments of the disclosed invention are meant to be included as coming within the scope of the claims, except insofar as they may be precluded by the prior art.

BRIEF DESCRIPTION OF THE DRAWINGS

The accompanying drawings illustrate complete preferred embodiments in the present invention according to the best modes presently devised for the practical application of the principles thereof, and in which:

FIG. 1 is a perspective view of the subject fence post with horizontal studs for quick fence wire connection. In this drawing, the fence post is shown with a plurality of horizontal studs with pinholes used for receiving inverted "L" shaped locking pins therethrough. The pins and selected pairs of horizontal studs are used for holding parallel strands of barbed wire in a wire gap between the horizontal studs and next to a side of the fence post.

FIG. 2 is a side view of a portion of the fence post with two pair of horizontal studs. Wire gaps, between the two pair of the studs, are shown with a portion of two strands of barbed wire received therein. The barbed wire is shown in cross section and held in the wire gaps by two inverted "L"

shaped locking pins received through locking pinholes in the studs and above the wires in the wire gaps.

FIG. 3 is a front view of the fence post with the two pair of horizontal studs and the inverted "L" shaped locking pin shown in FIG. 2. In this view, the wires are shown received in the wire gaps with a portion of the "L" shaped locking pins disposed above the wires and preventing them from being removed from the wire gaps.

DESCRIPTION OF THE PREFERRED EMBODIMENTS

In FIG. 1, a perspective view of the subject fence post with horizontal studs for quick fence wire connection is illustrated and having general reference numeral 10. The fence post for quick wire connection 10 is shown with a fence post 12 having a "T" shaped cross section. While the "T" shaped cross section is shown, it can be appreciated that the post 12 can have any number of different types of cross sections and post designs without departing from the spirit and scope of the invention as described. The post 12 can be made of metal, fiberglass and other types of fence post material. The post 12 in this drawing includes a plurality of horizontal studs 14 equally spaced along a length of the post. Each of the horizontal studs 14 includes vertical pinholes 16. The pinholes 16 are parallel and indexed with each other in adjacent studs 14. The pinholes 16 are used for receiving inverted "L" shaped locking pins 18 therethrough. While the horizontal studs 14 are shown in a rectangular configuration, it can be appreciated that the studs can have different geometric configurations with pinholes 16 therein.

In this drawing, the locking pins 18 and adjacent horizontal studs 14 are used for holding a portion of five parallel strands of barbed wire 20 next to a side 22 of the fence post 12. While the fence post for wire connection 10 is shown for receiving and holding a portion of five parallel strands of barbed wire 20, it should be kept in mind that the fence post 12 can be used for holding any number of strands of parallel barbed wire 20. Also, the invention can include any number of horizontal studs disposed along the length of the side 22 of the fence post 12 for holding the strands of wire.

While the barbed wire 20 is shown in the drawings, it should be kept in mind that any type of fence wire can be used equally well with the subject fence post for quick fence connection 10.

Typically, the fence post 12 will hold three to six parallel strands of wire 20, with the strands spaced apart a distance "X". The distance "X" is in a range of 6 to 18 inches and more specifically 12 to 14 inches with the space between the wire strands small enough to prevent livestock from crawling through. The distance "X" will vary depending on the number of wire strands attached to the fence post 12.

Also, it should be mentioned that because the studs 14 are equally spaced next to each other, added stands of wire 20 can be placed in an additional wire gap 24 between the adjacent pairs of horizontal studs 14. The additional strand or strands of wire 20 is held next to the side of the post 12 by extending the length of locking pin 18 and having it received through the pinholes 16 of both adjacent pairs of horizontal studs 14. Obviously, by placing added strands of wire 20 between the adjacent horizontal studs 14, the post 12 can have from 6 to 10 or more strands of wire 20 with a spacing of approximately 4 to 8 inches between each strand.

In FIG. 2, a side view of a portion of the fence post 12 is shown with a first pair and a second pair of horizontal studs 14. The second pair of horizontal studs 14 is disposed below the first pair of horizontal studs 14. A first wire gap 25, between the upper stud 14 and lower stud 14 of the first pair of studs 14, is shown with a portion of a first strand of barbed wire 20 received therein. Also, a second wire gap 27, between the upper stud 14 and lower stud 14 of the second pair of studs 14, is shown with a portion of a second strand of barbed wire 20 received therein. The first and second wire gaps 25 and 27 are the same dimension along the length of the post 12. Also, the additional wire gap 24 has the same dimension as the wire gaps 25 and 27.

The first and second strands of barbed wire 20 are shown in cross section and held in the wire gaps 25 and 27 by the inverted "L" shaped locking pins 18. The locking pins 18 are received through the locking pinholes 16 in the adjacent horizontal studs 14 with a portion of each of the locking pins 18 bridged over the wire 20 for holding it in the wire gaps 25 and 27. Obviously, the wire gaps 25 and 27 are disposed below the pinholes 16 so that the locking pins 18 can be easily received over the top of the wires 20 resting in the wire gaps 25 and 27 as shown. The pinholes 16 are shown in dashed lines in this drawing and in FIG. 3.

It should be mentioned, that each of the horizontal studs 14 has a side profile of a rectangular geometric shape. Also, the edges of each of the studs 14 are rounded for ease in inserting wire therebetween. The studs 14 include a vertical base 26 integrally attached to the side 22 of the post 12 and a parallel vertical top 28. The vertical top 28, as shown in the drawings, is rounded for ease in guiding the barbed wire 20 into the wire gaps 24, 25 and 27. Also, rather than rounded ends, the vertical top 28 can have beveled ends for guiding the barbed wire 20 into the wire gaps. An upper side 30 and a lower side 32 of the rectangular horizontal studs 14 are shown parallel to each other.

In each of the studs 14, the vertical locking pinhole 16 includes an upper opening in the upper side 30 and a lower opening in the lower side 32. As mentioned above, the adjacent pinholes 16 are used for receiving the inverted "L" shaped locking pin 18. The locking pin 18 can be made of various dimensions of wire depending on the diameter of the locking pinhole 16. Typically, a 9-gauge wire is used for making the inverted "L" shaped locking pin 18.

Also, the locking pin 18 can be extended in length to bridge the additional wire gap 24 between the first pair of horizontal studs 14 and the lower second pair of horizontal studs 14. In this example, the locking pin 18 is received through the vertical pinholes 16 of both of the two pair of studs. The locking pin 18 with an extended length is not shown in the drawings.

In FIG. 3, a front view of the fence post 12 with two pair of horizontal studs 14 is shown with the inverted "L" shaped locking pin 18 received through the pinholes 16 in the upper and lower studs as shown in FIG. 2. In this view, the wire 20 is shown received in the wire gaps 25 and 27 with a portion of the "L" shaped locking pin 18 disposed above the wire 20 and preventing it from being removed from the wire gaps.

In operation, when a portion of the wires 20 is inserted into the wire gaps 25 and 27 and the inverted "L" shaped locking pins 18 are inserted through the pinholes 16 in the adjacent horizontal studs 14. The locking pins 18 are received over the top of the portion of the wire 20. Thus, the wires 20 are held firmly in the wire gaps 25 and 27 and next to a portion of the "L" shaped locking pin 18. Obviously, by removing the locking pin 18 from the pinholes 16, the wire 20 can be easily removed from the fence post 12.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed except as precluded by the prior art.

What is claimed is:

1. A t-shaped fence post for quick fence wire connection adapted for receiving a portion of a first strand of fence wire and holding the fence wire thereon, the fence wire connection comprising:

a vertical fence post with a first pair of horizontal studs in one side of said post, said first pair of studs have a side profile of a rectangular geometric shape, said first pair of studs including a vertical base integrally attached to the side of said post and parallel to a vertical top, said first pair of studs having an upper side parallel to a lower side, edges of each of said first pair of studs and said vertical top are rounded, the rounding of said edges and said vertical top providing for ease in guiding the fence wire between said first pair of studs;

first vertical pinholes in said first pair of studs;

a first wire gap disposed between said first pair of studs, said first wire gap adapted for receiving a portion of the first strand of fence wire therein; and a first locking pin received in said first vertical pinholes and above said first wire gap, said first locking pin adapted for holding the portion of the first strand of fence wire in said wire gap.

2. The fence wire connection as described in claim 1 wherein said first locking pin is an inverted "L" shaped first locking pin.

3. The fence wire connection as described in claim 1 wherein said first vertical pinholes are parallel and indexed with each other in said first pair of studs.

4. The fence wire connection as described in claim 1 further including a second pair of horizontal studs in one side of said post and disposed below said first pair of horizontal studs, said second pair of studs having second vertical pinholes therein for receiving a second locking pin therethrough and a second wire gap between said second pair of studs, said second wire gap adapted for receiving a portion of a second strand of fence wire therein.

5. The fence wire connection as described in claim 4 wherein said second pair of studs have a side profile of a rectangular geometric shape, said second pair of including a vertical base integrally attached to the side of said post and parallel to a vertical top, said second pair of studs also including an upper side parallel to a lower side, edges of each of said second pair of studs and said vertical top are rounded, the rounding of said edges and said vertical top providing for ease in guiding the fence wire between said second pair of studs.

6. The fence wire connection as described in claim 4 wherein said first wire gap and said second wire gap have an equal space between said first pair of horizontal studs and between said second pair of horizontal studs.

7. The fence wire connection as described in claim 6 further including a third wire gap disposed between said first pair of horizontal studs and said second pair of horizontal studs, said third wire gap having a space equal to said first and second wire gaps, said third wire gap adapted for receiving a portion of a third strand of fence wire therein.

8. A t-shaped fence post for quick fence wire connection adapted for receiving a portion of a first strand of fence wire and holding the fence wire thereon, the fence wire connection comprising:

a vertical fence post with a first pair of horizontal studs in one side of said post, said first pair of studs have a side profile of a rectangular geometric shape, said first pair of studs including a vertical base integrally attached to the side of said post and parallel to a vertical top, said first pair of studs having an upper side parallel to a lower side, edges of each of said first pair of studs are rounded and said vertical top is beveled, the rounding of said edges and the beveling of said vertical top providing for ease in guiding the fence wire between said first pair of studs;

first vertical pinholes in said first pair of studs;

a first wire gap disposed between said first pair of studs, said first wire gap adapted for receiving a portion of the first strand of fence wire therein; and a first locking pin received in said first vertical pinholes and above said first wire gap, said first locking pin adapted for holding the portion of the first strand of fence wire in said wire gap.

9. The fence wire connection as described in claim 8 wherein said first locking pin is an inverted "L" shaped first locking pin.

10. The fence wire connection as described in claim 8 wherein said first vertical pinholes are parallel and indexed with each other in said first pair of horizontal studs.

11. The fence wire connection as described in claim 8 further including a second pair of horizontal studs in one side of said post and disposed below said first pair of horizontal studs, said second pair of horizontal studs having second vertical pinholes therein for receiving a second locking pin therethrough and a second wire gap between said second pair of horizontal studs, said second wire gap adapted for receiving a portion of a second strand of fence wire therein.

12. The fence wire connection as described in claim 11 wherein said second pair of horizontal studs have a side profile of a rectangular geometric shape, said second pair of horizontal studs including a vertical base integrally attached to the side of said post and parallel to a vertical top, said second pair of horizontal studs also including an upper side parallel to a lower side, edges of each of said second pair of studs are rounded and said vertical top is beveled, the rounding of said edges and the beveling of said vertical top providing for ease in guiding the fence wire between said second pair of horizontal studs.

13. The fence wire connection as described in claim 11 wherein said first wire gap and said second wire gap have an equal space between said first pair of horizontal studs and between said second pair of horizontal studs.

14. The fence wire connection as described in claim 13 further including a third wire gap disposed between said first pair of horizontal studs and said second pair of horizontal studs, said third wire gap having a space equal to said first and second wire gaps, said third wire gap adapted for receiving a portion of a third strand of fence wire therein.

15. A t-shape fence post for quick fence wire connection adapted for receiving a portion of a first strand of fence wire and a portion of a second strand of fence wire and holding the fence wires thereon, the fence wire connection comprising:

a vertical fence post with a first pair of horizontal studs in one side of said post, said first pair of studs including a vertical base integrally attached to the side of said post and parallel to a vertical top, said first pair of studs having an upper side parallel to a lower side, edges of each of said first pair of studs and said vertical top are rounded, the rounding of said edges and said vertical top providing for ease in guiding the fence wire between said first pair of studs;

first vertical pinholes in said first pair of studs;

a first wire gap disposed between said first pair of studs, said first wire gap adapted for receiving the portion of the first strand of fence wire therein;

a first locking pin received in said first vertical pinholes and above said first wire gap, said first locking pin adapted for holding the portion of the first strand of fence wire in said wire gap;

a second pair of horizontal studs in one side of said post and disposed below said first pair of horizontal studs, including a vertical base integrally attached to the side of said post and parallel to a vertical top, said second pair of studs having an upper side parallel to a lower side, edges of each of said second pair of studs and said vertical top are rounded, the rounding of said edges and said vertical top providing for ease in guiding the fence wire between said second pair of studs;

second vertical pinholes in said second pair of horizontal studs;

a second wire gap disposed between said second pair of studs, said second wire gap adapted for receiving the portion of a second strand of fence wire therein; and a second locking pin received in said second vertical pinholes and above said second wire gap, said second locking pin adapted for holding the portion of the second strand of fence wire in said second wire gap.

16. The fence wire connection as described in claim 15 wherein said first and second locking pins are inverted "L" shaped first and second locking pins.

17. The fence wire connection as described in claim 15 wherein said first and second vertical pinholes are parallel and indexed with each other in said first and second pair of studs.

18. The fence wire connection as described in claim 15 wherein said first wire gap and said second wire gap have an equal space between said first pair of horizontal studs and between said second pair of horizontal studs.

19. The fence wire connection as described in claim 18 further including a third wire gap disposed between said first pair of horizontal studs and said second pair of horizontal studs, said third wire gap having a space equal to said first and second wire gaps, said third wire gap adapted for receiving a portion of a third strand of fence wire therein.

* * * * *